United States Patent [19]

Lehmann et al.

[11] Patent Number: 4,461,256

[45] Date of Patent: Jul. 24, 1984

[54] DEVICE FOR FUEL INJECTION PUMPS

[75] Inventors: Werner Lehmann; Sieghart Maier, both of Gerlingen; Reinhard Schwartz, Stuttgart, all of Fed. Rep. of Germany

[73] Assignee: Robert Bosch GmbH, Stuttgart, Fed. Rep. of Germany

[21] Appl. No.: 411,716

[22] Filed: Aug. 25, 1982

[30] Foreign Application Priority Data

Sep. 4, 1981 [DE] Fed. Rep. of Germany ..... 3135046
Apr. 28, 1982 [DE] Fed. Rep. of Germany ..... 3215790

[51] Int. Cl.[3] ..... F02D 31/00

[52] U.S. Cl. ..... 123/367; 123/374; 74/526

[58] Field of Search ..... 123/367, 373, 374; 74/526

[56] References Cited

U.S. PATENT DOCUMENTS

| | | | |
|---|---|---|---|
| 2,259,693 | 10/1941 | Hogemann | 123/373 |
| 2,477,589 | 8/1949 | Shane | 74/526 |
| 3,093,125 | 6/1963 | North | 74/526 |
| 3,620,199 | 11/1971 | Kuhn et al. | 123/374 |
| 3,902,470 | 9/1975 | Tomsett | 123/373 |
| 3,903,860 | 9/1975 | Maier | 123/374 |
| 4,164,925 | 8/1979 | Maier et al. | 123/374 |
| 4,305,362 | 12/1981 | Schwartz et al. | 123/367 |
| 4,353,340 | 10/1982 | Straubel et al. | 123/367 |

FOREIGN PATENT DOCUMENTS

| | | | |
|---|---|---|---|
| 2656261 | of 0000 | Fed. Rep. of Germany . | |
| 764070 | 12/1956 | United Kingdom | 123/374 |
| 1584033 | 2/1981 | United Kingdom | 123/367 |

*Primary Examiner*—Magdalen Y. C. Moy
*Attorney, Agent, or Firm*—Edwin E. Greigg

[57] ABSTRACT

The device has a scanning member, adjustable in relation to the rpm, for the determination of the full load injection amount and a support attachable to a base and holding a contour disk in a predetermined position, the latter serving as a stop for the scanning member. The support can be attached with the aid of a holding element in such a way, that the first adjustment position of the support equipped with the contour disk is permanently fixed. Even after the support has been removed, its renewed fixing in the first adjustment position is assured (FIG. 3).

8 Claims, 3 Drawing Figures

DEVICE FOR FUEL INJECTION PUMPS

BACKGROUND OF THE INVENTION

The invention is based on a device for fuel injection pumps of the type revealed hereinafter which are known from, for instance, German Offenlegungsschrift No. 26 56 261. If the performance characteristics and, along with them the full load area of an injection pump is to be changed, the present contour disk has to be exchanged for one the contour of which corresponds to the future characteristics and to the full load area. This exchange necessitates a new adjustment of the fuel injection pump on the test bench. Lately, the shops have demanded that this comparatively expensive adjustment be avoided or at least be more simplified.

OBJECT AND SUMMARY OF THE INVENTION

With the device for fuel injection pumps according to the present invention the disadvantages shown in the state of the art devices is avoided and it becomes possible by simple means to exchange the contour disk without having to place the fuel injection pump on the test bench.

The invention will be better understood and further objects and advantages thereof will become more apparent from the ensuing detailed description of preferred embodiments taken in conjunction with the drawings.

BRIEF DESCRIPTION OF THE DRAWINGS

Two embodiments of the present invention are shown in the drawings and described in detail in the description of the figures. In enlarged scale are shown, respectively.

DESCRIPTION OF THE PREFERRED EMBODIMENTS

Figure 1:
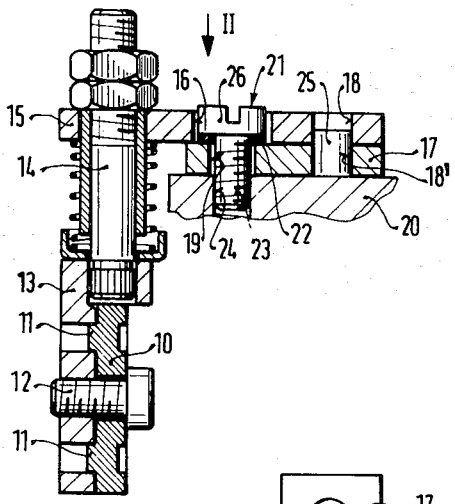
FIG. 1—which shows a cross-sectional view of the first embodiment along line I—I of FIG. 2.
Figure 2:
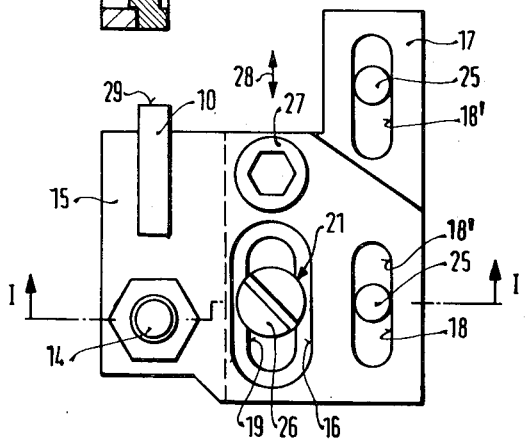
FIG. 2—which shows a top plan view in the direction towards II of FIG. 1.

A device for fuel injection pumps in FIGS. 1 and 2 is equipped with a contour disk 10, which is fastened in a predetermined position to a flange 13 with the aid of two centering pieces 11 and a screw 12. The flange is connected to a level support 15 with the aid of a positioning device 14. A slotted hole 16 and a slit 18 (see FIG. 2) are hollowed out of the support 15.

A plate 17, serving as a holding element, has a slotted hole 19 and two slits 18' corresponding to the slit 18 and is disposed between the support 15 and a housing 20, serving as a support of a known, and therefore not shown, centrifugal force regulator of the injection pump. The fastening of the plate 17 on the housing 20 is done by means of a shim 22 a head screw 21, the threaded shaft 23 of which is screwed into an inner thread 24 of the housing 20 through the slotted hole 19 of the plate 17. Two pins 25 entering the slits 18 and 18' extend from the housing. The slotted hole 16, in its width, is at least equal to or preferably larger than the diameter of the screw head 26 disposed therein.

By means of a screw 27 with a hexagonal recessed hole, disposed as a fitted bolt and serving as adjusting means, the support 15 is fastened to the plate 17 in that, in a manner not shown, the screw head is screwed into an inner thread of the plate 17 through a fitted bore in the support 15. The longitudinal dimensions of the two slotted holes 16 and 19 as well as that of the slits 18 and 18' lies in the direction in which adjustment of the support 15, equipped with the contour disk 10, is performed, i.e. in the direction of the arrow 28.

In order to obtain the first adjustment shown on the test bench, the unit consisting of plate 17 and support 15 with the contour disk 10 and joined by screw 27 is displaced in the direction of the arrow 28, and this first adjustment position is secured by the tightening of the head screw 21. If the support 15 needs to be exchanged, it is removed from the plate 17 by threading the screw 27. Then a support 15, equipped with a corrected or different contourdisk 10, is repositioned on the plate 17 and is fastened by means of the screws 27 on the plate 17. The same attachment position in the original adjustment position is guaranteed because of the placement by means of the screw 27 and the pin 25.

Figure 3:
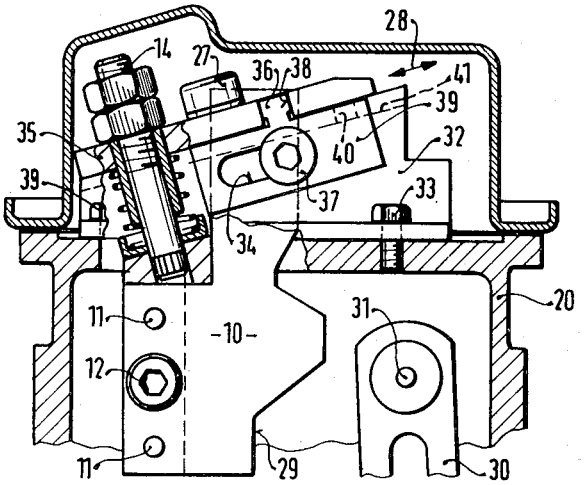
FIG. 3—which generally shows in cross-section the second embodiment in a transverse section parallel to the contour disk, however, in normal scale.

The second embodiment in FIG. 3 shows partially the housing 20 of a regulator (not shown) of an injection pump with a scanning member 31 placed next to an arm 30.

This scanning member 31 cooperates with the curved path 29 of the contour disk 10. The scanning member constructed as a pin 31 is adjustable depending on the revolutions of the engine, and the full load injection amount of the pump is determined by its cooperation with the contour disk 10. A housing part 32 is fixed by four screws 33 to the housing 20 and fastened thereto. Further, the housing part 32 contains a support 35, which is equipped with the contour disk 10, and therefore serves as a base for the support 35. The latter has a slotted hole (not shown) extending in the adjustment direction, through which the screw 27, used to fasten the support 35, is inserted and then is screwed into the housing part 32. An arresting plate 39 has a tongue 36 serving as holding element and a slotted hole 34, the longitudinal extension of which is in the direction of adjustment (see arrow 28) of the support 35. The plate 39 is fastened to the housing part 32 by means of a screw 37, which is passed through the slotted hole 34, and the support 35 has a recess 38 to accommodate the tongue 36.

To keep the support 35 straight and having the same function as the pins 25 described in connection with FIGS. 1 and 2, two pins 40 extend from the support 35, only one of which is shown in FIG. 3 by a broken line, and which engage a guide slot 41, shown by a broken line, of the housing part 32, thereby fixing the adjustment direction of the support 35, shown by the arrow 28.

For a first adjustment position of the device the support 35, equipped with the contour disk 10, is placed on the housing part 32 fastened to housing 20, and is held by screw 27, which is lightly fastened and therefore allows an adjustment of the support 35. Thereafter the plate 39, too, is slightly fastened to the housing part 32 by the screw 37, whereby the tongue of the plate extends into the recess 38. By moving the support 35 and the plate 39 at the same time, the desired adjustment position is determined and thereafter support 35 as well as plate 39 are tightly screwed down by the final tightening of the screws 27 and 37.

If a different contour disk 10 with a curved path different from curved path 29 is to be used, it is exchanged after the screw 12 has been removed and the support 35 has been taken off. In order to take off the support 35 it is only necessary to remove the screw 27 and then to replace the screw after the support 35 has been replaced. The first and former adjustment position of the latter is thereby guaranteed by the cooperation of the recess 38 and the tongue 36.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A housed device for fuel injection pumps with an adjustable scanning member for the determination of the full load injection amount, which is dependent on the rpm, and said device further provided with a support means fastened to a base, said support means arranged to hold a contour disk in a predetermined position, and said disk arranged to serve as a stop for said scanning member, characterized in that said contour disk is detachable and refastened in a reproducible position on said support means and said support means is fastened to said base by interposition of a holding element which holding element is adjustably fastened to said base and held in its fastened position after adjustment so that a first adjustment position of said support means, equipped with said contour disk is fixed and that its renewed fastening in said first adjustment position is assured, said holding element including an arresting plate provided with a slotted hole extending in a longitudinal adjustment direction of said support means whereby said arresting plate is fastened to said base by a screw means which passes through said slotted hole.

2. A device according to claim 1, characterized in that said arresting plate includes a tongue, and further that said support means has a recess, into which said tongue extends thereby assuring the first adjustment position.

3. A device according to claim 2, characterized in that said base is firmly connected with said housing and further that said base together with said arresting plate and said support means carrying said contour disk are releasable therefrom.

4. A device in accordance with claim 3, characterized in that said support means is provided with a pair of pins and further that said base includes corresponding slot means whereby an adjustment level of said support means may be fixed.

5. A device in accordance with claim 1, characterized in that an adjusting means releasably connects said support means with said arresting plate whereby a first adjustment position is achieved.

6. A device in accordance with claim 5, characterized in that in said support means further includes a slotted aperture corresponding to an aperture in said arresting plate, said slotted aperture in said support base arranged to receive therein the head of said head screw.

7. A device in accordance with claim 5, characterized in that said housing further includes two pins which extend into at least one slit of said arresting plate and said support means and thereby fix the adjustment direction in which the adjustment of said support means takes place.

8. A device in accordance with claim 6, characterized in that said housing further includes two pins which extend into at least one slit of said arresting plate and said support means and thereby fix the adjustment direction in which the adjustment of said support means takes place.

* * * * *